US005134933A

United States Patent [19]

Dubuit

[11] Patent Number: 5,134,933

[45] Date of Patent: Aug. 4, 1992

[54] PRINTING MACHINE

[76] Inventor: Jean-Louis Dubuit, 63 Rue du Chemin Vert, 75011 Paris, France 75011

[21] Appl. No.: 596,009

[22] Filed: Oct. 11, 1990

[30] Foreign Application Priority Data

Oct. 16, 1989 [FR] France ..... 89 13481

[51] Int. Cl.[5] ..... B41L 13/18; B41L 27/00

[52] U.S. Cl. ..... 101/123; 101/124; 101/126

[58] Field of Search ..... 101/123, 115, 124, 126

[56] References Cited

U.S. PATENT DOCUMENTS

| | | | |
|---|---|---|---|
| 3,090,300 | 5/1963 | Dubuit | 101/123 |
| 3,113,510 | 12/1963 | Dubuit | 101/124 |
| 3,126,824 | 3/1964 | Dubuit | 101/124 |
| 3,838,639 | 10/1974 | Harwell, Jr. et al. | 101/123 |
| 4,111,118 | 9/1978 | Green et al. | 101/123 |
| 4,184,427 | 1/1980 | Bubley et al. | 101/123 |

FOREIGN PATENT DOCUMENTS 1263239 5/1961 France .

*Primary Examiner*—Edgar S. Burr
*Assistant Examiner*—Lynn D. Hendrickson
*Attorney, Agent, or Firm*—Longacre & White

[57] ABSTRACT

The carriage of a printing machine, in particular a silk-screen printing machine, carrying the printing device is mobile on a guide carried by arms forming with uprights a set of deformable parallelograms. Lifting means include a cam whose edge cooperates with a cam follower roller carried by a longitudinal member controlling this set of deformable parallelograms. The longitudinal member is pivotally supported by two same level arms of the set of deformable parallelograms. It interacts with an angular orientation maintaining device which maintain the axis of the cam follower roller parallel to the axis of the cam.

9 Claims, 1 Drawing Sheet

PRINTING MACHINE

BACKGROUND OF THE INVENTION

1. Field of the Invention

The present invention is generally concerned with printing machines of the kind in which the printing means is carried by a carriage which reciprocates on a guide.

It is more particularly directed to printing machines in which the printing means must be raised after printing an object.

This is the case with silkscreen printing machines when the objects to be printed are cylindrical, as the printing means (here a silk-screen) has to be taken out of contact with a printed object to prevent smudging the latter during return movement.

This poses the problem of raising the carriage guide carrying the silk-screen.

2. Description of the prior art

French patent No 1,263,239 corresponding to U.S. Pat. No. 3,090,300 proposes that the guide interconnect two deformable parallelograms or four-bar linkages which are controlled in an appropriate way.

French patent No 1,263,239 and U.S. Pat. No. 3,090,300 propose a printing machine comprising a frame, a guide formed by two parallel bars pivotally connected to upright arms which are part of deformable parallelograms or four-bar linkages also including cross arms pivoted to the frame. A carriage carries the printing means and reciprocates on the guide. Drive means cause the carriage to reciprocate on the guide. Lifting means cyclically rocks the upright arms carrying the guide so as to raise the printing means temporarily. The lifting means includes a cam rotatable about an axis perpendicular to the plane defined by the parallel. The edge of the cam cooperates with a cam follower roller carried by a longitudinal member controlling the deformable parallelograms.

In French patent No 1,263,239 and U.S. Pat. No. 3,090,300 the longitudinal member comprises a lever which is pivoted at one end to the frame and coupled at the other end by an arm or link of one of the deformable parallelograms.

This arrangement is satisfactory.

However, the object of the present invention is to simplify it.

SUMMARY OF THE INVENTION

The present invention comprises a printing machine comprising a frame, a carriage guide, a carriage for carrying printing means being mounted on the guide for reciprocating movement thereon, drive means for reciprocating displacement of the carriage along the guide, the guide comprising two parallel bars pivotally connected at their respective ends to upright arms, each of said upright arms being pivotally connected to cross arms, the cross arms being pivotally connected to the frame, each of said upright arms and its associated cross arms defining a deformable parallelogram, carriage lifting means comprising a control cam rotatable about an axis perpendicular to a plane defined by the parallel bars, a longitudinal member for controlling the movement of the deformable parallelograms, a cam follower roller carried by the longitudinal member and in cooperable engagement with an edge of said control cam, the longitudinal member being pivotally connected at its respective ends to a pair of the cross arms of the respective deformable parallelograms disposed at the same level, and roller orienting means for maintaining the axis of the cam follower roller parallel to the axis of said control cam.

The roller orienting means for maintaining the axis of the follower roller axis parallel to the axis of the control cam comprises, for example, an upright member pivotally connected between the two cross arms of one of the deformable parallelograms, the upright member being fixed for angular displacement with the longitudinal member.

Alternatively, the roller orienting means comprises a yoke having arms engageable with parallel surfaces on said longitudinal member, the yoke interacting with an upright member extending between cross arms of one of the deformable parallelograms.

Because of the roller orienting means employed in accordance with the invention, the cam follower roller is not subject to any tilting moment relative to the edge of the control cam on which it bears, and a generatrix defining the edge of the cam follower roller remains in contact with the edge of the control cam at all times.

At worst the follower roller is subject to sight axial displacement relative to the control cam because of moderate angular deformation of the deformable parallelograms.

Because the axis of the follower roller and the axis of the cam are maintained parallel, the operation of the printing machine in accordance with the invention is totally reliable even though the number of component parts is advantageously reduced, and with it the unit manufacturing cost.

In contrast to the above mentioned French and U.S. patents it is no longer necessary to provide a finger which forms an extension of one of the cross arms of one of the deformable parallelograms.

The features and advantages of the invention will be brought out in the following description, given by way of example only, with reference to the appended diagrammatic drawings.

DESCRIPTION OF THE PREFERRED EMBODIMENTS

Figure 1:
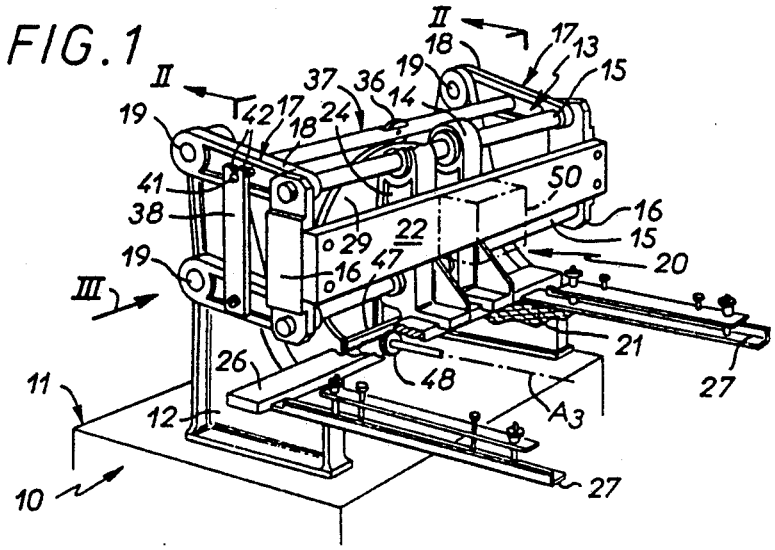
FIG. 1 is a partially cut away perspective view of a printing machine in accordance with the invention.
Figure 5:
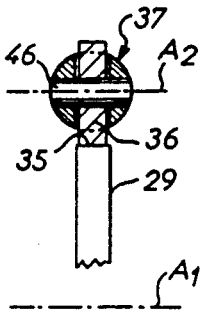
FIG. 5 shows to a larger scale detail view of the area included in a dotted-line box V in FIG. 4.
Figure 2:
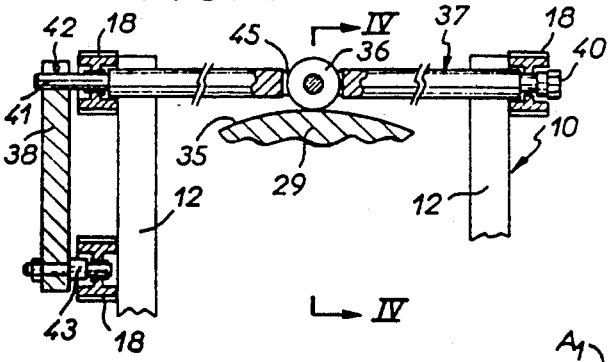
FIG. 2 is a detail view of the printing machine in longitudinal cross-section on the line II—II in FIG. 1.

The figures show a silkscreen printing machine of the kind described in the above mentioned French patent 1,263,239 and U.S. Pat. No. 3,090,300 the letter of which is incorporated herein by reference.

The machine comprises a frame 10 comprising a horizontal table 11 and two vertical side frames 12 attached to the table and disposed parallel to and spaced from each other. A guide 13 is defined by two parallel bars 15 pivotally connected to upright arms or links 16 at respective ends thereof, and rockably mounted by the opposed deformable parallelograms o four-bar linkages 17 to be described in more detail later. Each of the deformable parallelograms includes one such upright arm or link 16, two cross arms or links 18 which in turn are pivoted at 19 on the corresponding side frame 11 of the frame 10. A carriage 20 carries printing mean which in the illustrated embodiment is a silkscreen member 21 and is mounted for reciprocable movement on the guide 13.

The cross arms 18 are disposed outside the side frames 12. Each deformable parallelogram or four-bar linkage has two parallel cross arms 18 at two different levels, at each end of the guide 13.

The guide 13 is therefore connected to the two deformable parallelograms 17, at the respective ends thereof. Each deformable parallelogram comprises a corresponding upright arm or link 16 pivotally connected to the upright arm 16 at one end and the side frame 12 at the other.

For reasons that will be brought out later, the two uprights arms 16 are joined together by a longitudinal bar 22 parallel to and intermediate the bars 15.

The carriage 20 has two upright legs 24 which are slidable on bars 15.

Figure 4:
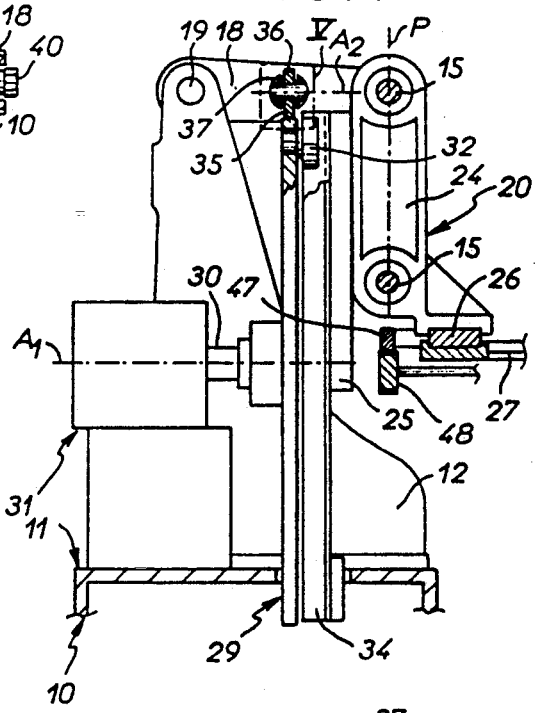
FIG. 4 is a partial transverse cross-sectional view of the printing machine taken on the line IV—IV in FIG. 2.

The backs of the upright legs 24 are joined together by a flange 25 (see FIG. 4).

A lower bar 26 is carried by a lower transverse legs integral with upright legs 24 and is parallel t guide bars 15. Two carrier arms 27 adapted to carry the printing means 21 are centilevered transversally from lower bar 26.

Plane P defined by the guide bars 15 lies in a vertical plane. The printing means 21 lies in a horizontal plane.

These arrangements are well known per se and as they do not form part of the improvement of the present invention they will not be described in further detail herein.

In a way that is also known per se, a control means is provided to produce cyclic reciprocating motion of the carriage 20 on the guide 13.

As described in French patent No 1,263,239 and U.S. Pat. No. 3,090,300, the control means includes a control cam 29 rotatable about an axis A1 perpendicular to the plane P defined by the guide bars 15 and keyed or fixed to the output shaft 30 of a motor-gearbox unit 31 carried by the table 11 of the frame 10. At a point spaced from the axis A1 control cam carries a roller 32 engaged in a vertical groove in the carriage 20 defined between two strips 34 disposed vertically and attached to the back of flange 25 (see FIG. 4).

The control cam 29 drives the carriage 20 directly.

In a manner that is also known per se, a lifting means is provided to rock cyclically the cross arms 18 carrying the guide 13 so as to raise the printing mean 21 temporarily and keep it horizontal.

The lifting means also incorporates the control cam 29.

To this end the edge 35 of the control cam cooperates with a cam follower roller 36 carried by the longitudinal member 37 for controlling the movement of the deformable parallelograms 17 to which the guide 13 is attached.

According to the invention, the longitudinal member 37 is pivotally connected to two cross arms 18 at the same level (here the upper cross arms) of the respective deformable parallelograms 17 and engages roller orienting means for maintaining the axis A2 of the cam follower roller 36 parallel to the axis Al of the control cam 29.

In a first embodiment shown in FIGS. 1 through 5 the roller orienting means includes an upright member 38 pivotally connected to the (upper and lower) cross arms 18 of one of the deformable parallelograms 17, and disposed parallel to the upright arms or links 16 and between the upright arms 16 and the pivots 19 for the cross arms 18 on the associated side frames 12 of the frame 10. The longitudinal member 37 is keyed to the upright member 38 and fixed for angular movement therewith.

The longitudinal member 37 extends directly between two cross arms 18 at the same level of the respective deformable parallelograms 17, namely the upper cross arms 18. The longitudinal member is fixed at one of the cross arms 18 by means of a nut 40. The other end of the longitudinal member has a reduced diameter extension 41 end extending beyond the other of the pair of cross arms 18 for axial movement relative thereto.

The upright member 38 is outside the cross arms 18 relative to the side frame 12. The upper end of upright member 38 is fixed or constrained to rotate with the reduced diameter extension 41 of the longitudinal member 37.

For this purpose the upper end of the upright member 38 has two jaws 42 by means of which it is clamped to the extension 41.

It is therefore through the intermediary of the reduced diameter extension 41 of the longitudinal member 37 that the upright member 38 is pivotally connected to the upper cross arm 18 of the corresponding deformable parallelogram 17.

At its lower end the upright member 38 is pivotally connected by pivot 43 to the other or lower arm 18 of the corresponding deformable parallelogram 17.

The cam follower roller 36 is accommodated transversely within the longitudinal member 37 as it is lodged in a diametral slot 45 in the longitudinal member.

The cam follower roller 36 rotates on a shaft 46 passing transversely through the longitudinal member 37 perpendicularly to the sides of the slot 45.

Because the cam follower roller 36 is disposed transversely within the slot 35, the cam follower roller 36 bears in registration with the edge 35 of the control cam 29 without offset or overhang and therefore with no tilting moment.

The printing machine further comprises a rack 47 parallel to the carriage guide bars 15 and fixed to move with the carriage.

The rack 47 meshes with a pinion 48 which imparts rotational movement about an axis A3 perpendicular to the plane P defined by guide bars 15 to support means for a cylindrical object to be printed. Rack 47 is pivotally connected at one end to the carriage 20 about an axis parallel to the axis A3 so that the rack bears by the force of gravity on the pinion 48. The other end guided is in a groove on the carriage 20.

Figure 3:
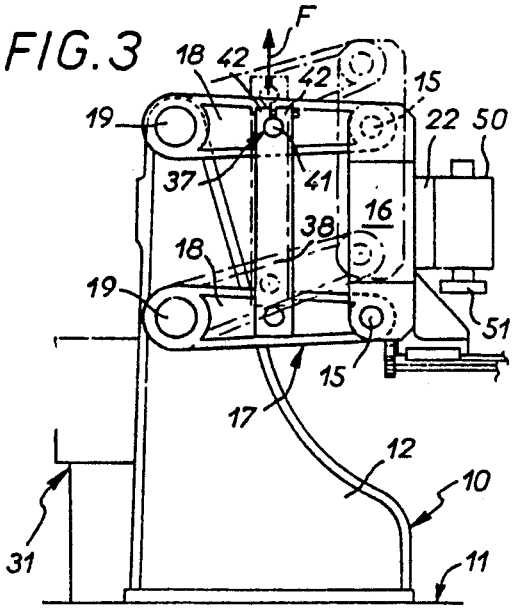
FIG. 3 is an end view in the direction of the arrow III in FIG. 2.

In a manner that is also known per se, a support 50 carried by the longitudinal bar 22, as schematically represented in dashed outline in FIG. 1, carries a doctor blade or squeegee 51, as shown in FIG. 3, associated with an independent lifting means, not shown.

As these arrangements are well known per se and do not form part of the improvement of the present invention they will not be described in further detail herein.

In operation, each revolution of the control cam 29 moves the carriage 20 on its guide 13 first in one direction and then in the opposite direction.

The movement in the first direction prints the object to be printed and the movement in the opposite direction returns the carriage 20 to its initial position.

In a manner that is known per se the profile or surface of the edge 35 of the cam 29 has a localized boss of enlarged thickness adapted, during return movement of the carriage 20, to lift the longitudinal member 37 in the direction of the arrow F in FIG. 3 thereby raising the carriage 20 and the printing means 21 through guide 13 and deformable parallelogram 17.

The raising of the carriage 20 involves pivoting of the cross arms 18 of the deformable parallelograms 17 about their respective pivots 19, as schematically illustrated in dashed outline in FIG. 3. During this movement the upright member 38 to which the longitudinal member 37 is keyed remains vertical and parallel to the upright arms 16 of the corresponding deformable parallelogram 17.

As a result, the axis A2 of the cam follower roller 36 remains parallel to the axis A1 of the control cam 29 and bears against the edge 35 of the control cam 29.

Figure 6:
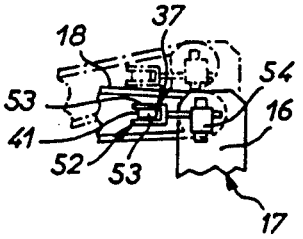
FIG. 6 is a partial end view corresponding to FIG. 3, for another embodiment.

In the embodiment schematically shown in FIG. 6 the roller orienting means interacting with the longitudinal member 37 carrying the cam follower roller 36 comprises a yoke 52 having two parallel arms fitted over two parallel flats 53 provided on the reduced diameter extension 41 of the longitudinal member 37. The yoke has a third arm extending away from the two parallel arms which interacts with an upright member pivoted between the two cross arms 18 of the corresponding deformable parallelogram 17.

In this embodiment, the upright member coincides with the upright arm 16.

However, alternatively a separate upright member parallel to the upright arms may be provided.

The third arm of the yoke 52 interacts with the upright member through the intermediary of a slider member 54 which guides the third arm for reciprocating movement in a direction perpendicular to the plane P defined by guide bars 15 and for reciprocating movement on the upright member in a direction parallel to plane P. This arrangement operates similar to a two-axis XY table.

As in the preceding embodiment the axis A2 of the cam follower roller 36 thus remains at all times parallel to the axis A1 of the control cam 29.

Of course, the present invention is not limited to the embodiments described and shown but encompasses any variant implementation thereof.

In particular, the foregoing description is directed to an printing machine for printing objects having circular or oval cross sections and a cylindrical surface. The expression "printing means" refers to the silkscreen member which moves in contact with this cylindrical surface while the associated doctor blade or squeegee is fixed. This term also encompasses the doctor blade or squeegee when the surface to be printed is flat and the doctor blade or squeegee is moved while the silk-screen member is fixed.

There is claimed:

1. Printing machine comprising a frame (10), a carriage guide (13), a carriage (20) for carrying printing means (21) being mounted on said guide for reciprocating movement thereon, drive means (29, 32, 34) for reciprocating displacement of said carriage along said guide, said guide comprising two parallel bars (15) pivotally connected at their respective ends to upright arms (16), each of said upright arms being pivotally connected to cross arms (18), said cross arms being pivotally connected to said frame (at 19), each of said upright arms and its associated cross arms defining a deformable parallelogram (17), carriage lifting means comprising a control cam (29) rotatable about an axis perpendicular to a plane (P) defined by the parallel bars (15), a longitudinal member (37) for controlling the movement of the deformable parallelograms, a cam follower roller (36) carried by said longitudinal member and in cooperable engagement with an edge (35) of said control cam, said longitudinal member being pivotally connected at its respective ends to a pair of said cross arms of the respective deformable parallelograms disposed at the same level, and roller orienting means for maintaining the axis (A2) of the cam follower roller parallel to the axis (A1) of said control cam.

2. Printing machine according to claim 1, wherein the roller orienting means comprises an upright member (38) pivotally connected between the two cross arms (18) of one of said deformable parallelograms (17), said upright member being fixed for angular displacement with said longitudinal member (37).

3. Printing machine according to claim 1, wherein said roller orienting means comprises a yoke (52) having parallel arms engageable with parallel surfaces (53) on said longitudinal member (37), said yoke having a third arm interacting with an upright member (16) extending between cross arms (18) of one of said deformable parallelograms.

4. Printing machine according to claim 3, wherein a slider member (54) is operatively disposed between the third arm of said yoke (52) and said upright member (16) for reciprocal movement parallel to the plane defined by the parallel guide bars (15), and said yoke (52) being mounted for reciprocal movement perpendicular to the plane (P) defined by the parallel guide bars.

5. Printing machine according to claim 1, wherein said longitudinal member (37) extends directly between said cross arms (18) at the same level of the respective deformable parallelograms (17).

6. Printing machine according to claim 5, wherein said longitudinal member (37) is fixed axially relative the cross arm at one of its ends (at right in FIG. 2) and is free for axial movement relative to the cross arm at the other of its ends (at left in FIG. 2).

7. Printing machine according to claim 1, wherein the cam follower roller (36) is accommodated transversely within the longitudinal member (37) and lodged in a slot (45) therein.

8. Printing machine according to claim 1, wherein said frame (10) comprises a pair of parallel side frames (12), said other ends of the cross arms (18) of one of said deformable arms being pivoted to one of said side frames (at 19) and the other ends of the other of said cross arms (18) being pivoted to the other of said side frames (at 19), said cross arms being disposed on a side of its side frame remote from the other side frame.

9. Printing machine according to claim 1, wherein said carriage drive means incorporates said control cam (29) which actuates said carriage (20) directly.

* * * * *